United States Patent [19]

Suzuki

[11] Patent Number: 4,562,797

[45] Date of Patent: Jan. 7, 1986

[54] FOUR-CYCLE ENGINE FOR MARINE PROPULSION DEVICE

[75] Inventor: Tomonori Suzuki, Hamamatsu, Japan

[73] Assignee: Sanshin Kogyo Kabushiki Kaisha, Hamamatsu, Japan

[21] Appl. No.: 643,644

[22] Filed: Aug. 23, 1984

[30] Foreign Application Priority Data

Aug. 25, 1983 [JP] Japan ..... 58-154173

[51] Int. Cl.[4] ..... F01M 9/10

[52] U.S. Cl. ..... 123/90.34; 123/196 R

[58] Field of Search ..... 123/90.34, 196 R, 196 M, 123/90.59

[56] References Cited

U.S. PATENT DOCUMENTS

| | | | |
|---|---|---|---|
| 1,475,965 | 12/1923 | Pence | 123/90.34 |
| 1,565,352 | 12/1925 | Ellis | 123/196 R |
| 1,684,955 | 9/1928 | Goodwin | 123/90.34 |
| 2,296,178 | 9/1942 | Patterson | 123/196 R |
| 3,286,792 | 11/1966 | Wall | 123/196 R |
| 4,258,673 | 3/1981 | Stoody, Jr. et al. | 123/90.34 |
| 4,280,456 | 7/1981 | Klomp | 123/196 R |

*Primary Examiner*—Ira S. Lazarus

*Attorney, Agent, or Firm*—Ernest A. Beutler

[57] ABSTRACT

Several embodiments of outboard motors incorporating improved arrangements for lubricating the cam lobes and associated components of the camshaft that is relatively independent of the pressure lubricating system of the engine. In each embodiment, a porous member is saturated with lubricant and engages the cam lobe surface so as to lubricate it even immediately upon starting.

18 Claims, 5 Drawing Figures

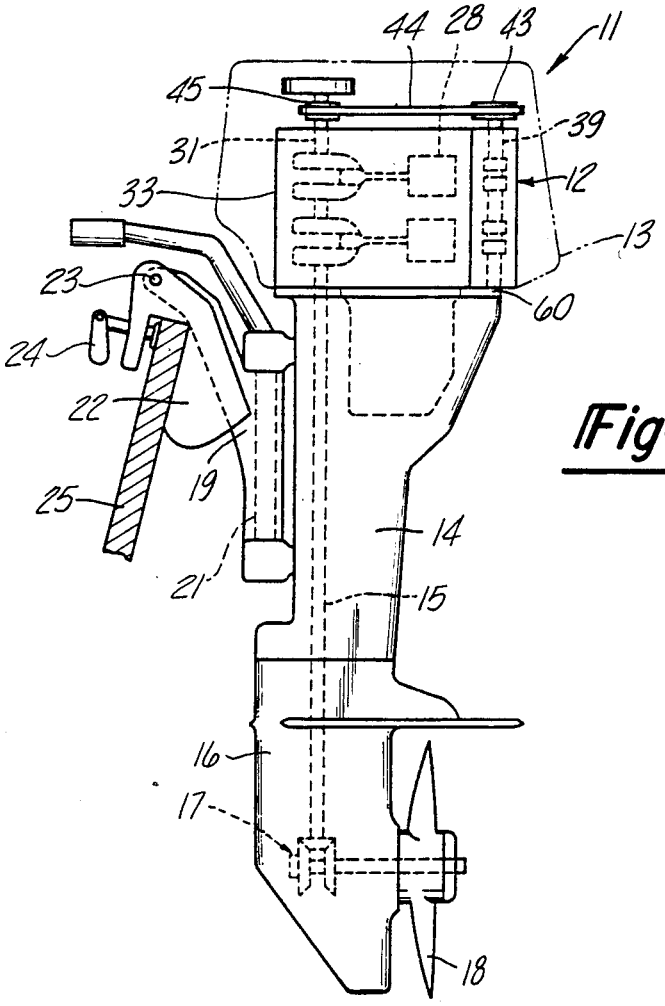
Fig-1
Fig-3
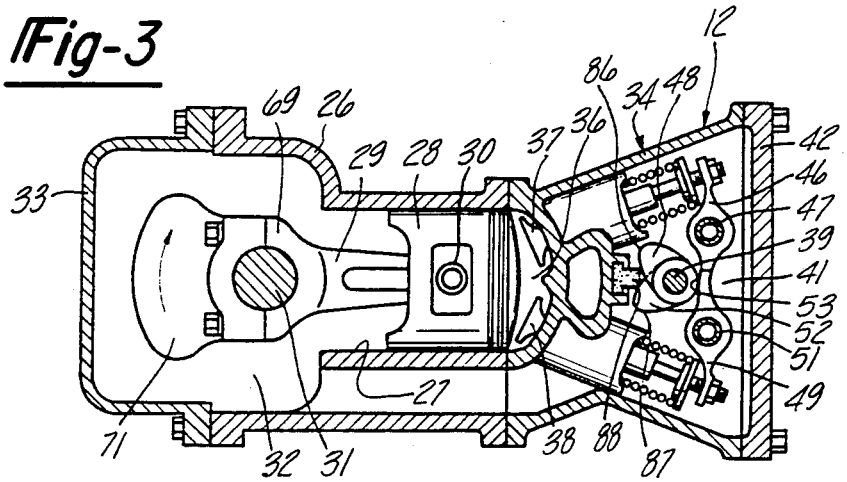

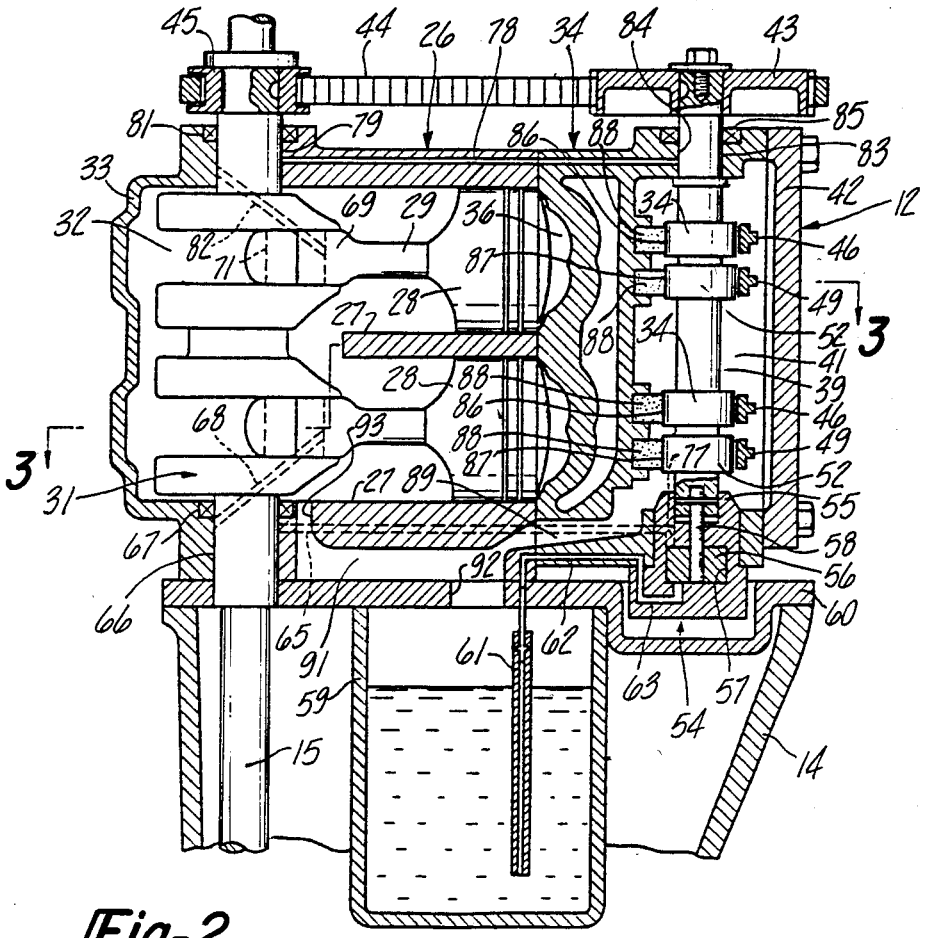
Fig-2
Fig-4
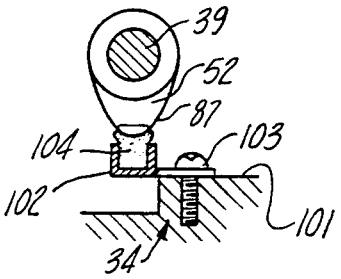
Fig-5
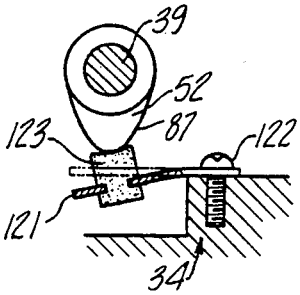

FOUR-CYCLE ENGINE FOR MARINE PROPULSION DEVICE

BACKGROUND OF THE INVENTION

This invention relates to a four-cycle engine for a marine propulsion device and more particularly to an improved method for lubricating the camshaft of an internal combustion engine.

As is well known, most internal combustion engines operating on four-stroke cycle principles are provided with a pressure lubricating system for lubricating the components of the engine. Quite frequently, as with the case of an overhead camshaft engine, the camshaft is located remotely from the oil pump. As a result, the critical bearing surfaces of the camshaft such as the cam lobes and the valves or rocker arms which they engage do not receive lubricant immediately upon starting of the engine. Frequently, the engine may run for some brief period of time before lubricant reaches these critical components.

When the engine is operated in conjunction with an outboard motor, it is the normal practice to dispose the engine so that its output shaft rotates about a vertically extending axis. When this is done, the camshaft is also supported for rotation about a vertically extending axis and this further complicates the problem in lubricating the camshaft and specifically the cam lobes and the elements which they operate.

It is, therefore, a principal object of this invention to provide an improved lubricating system for an internal combustion engine.

It is another object of this invention to provide a lubricating system for an internal combustion engine that insures lubrication of the camshaft lobes and related mechanism even during starting.

SUMMARY OF THE INVENTION

This invention is adapted to be embodied in a lubricating system for an internal combustion engine including a camshaft journaled by the engine. The engine is provided with a lubricating system including a lubricant pump for delivering lubricant under pressure to at least some of the components of the engine. In accordance with this invention, porous means adapted to engage a surface of the camshaft to be lubricated are provided with means for delivering lubricant to them from the lubricant pump so that the cam surface will be lubricated at all times when the engine is turning.

BRIEF DESCRIPTION OF THE DRAWINGS

FIG. 1 is a side elevational view of an outboard motor constructed in accordance with an embodiment of the invention.

FIG. 2 is an enlarged cross-sectional view of the engine of the outboard motor taken through the axis of its cylinder bores.

FIG. 3 is a cross-sectional view taken along the line 3—3 of FIG. 2.

FIG. 4 is an enlarged view showing another embodiment of the invention.

FIG. 5 is an enlarged view, in part similar to FIG. 4, showing a still further embodiment of the invention.

DETAILED DESCRIPTION OF THE PREFERRED EMBODIMENTS

Referring first to FIG. 1, an outboard motor constructed in accordance with an embodiment of the invention is identified generally by the reference numeral 11. The outboard motor 11 includes a power head consisting of an internal combustion engine, indicated generally by the reference numeral 12, and a surrounding protective cowling, which is shown in phantom in FIG. 1 and which is identified by the reference numeral 13. A drive shaft housing 14 depends from the power head and contains a drive shaft 15 that is driven by the engine output shaft in a manner to be described. A lower unit 16 is positioned at the lower end of the drive shaft housing 14 and contains a forward, neutral, reverse transmission 17 which is driven by the drive shaft 15 and, in turn, is adapted to drive a propeller 18 in a well known manner.

The drive shaft housing 14 is connected to a swivel bracket 19 by means including a steering shaft 21 for steering of the motor 11 about a vertically extending axis relative to the swivel bracket 19. The swivel bracket 19 is, in turn, affixed to a clamping bracket 22 by means of a tilt pin 23 so that the motor 11 may be tilted about a horizontally extending tilt axis defined by the pin 23. The clamping bracket 22 carries a clamp 24 so that the motor 11 may be detachably affixed to a transom 25 of an associated watercraft.

Referring now additionally to the remaining figures, the engine 12 is of the two cylinder in-line type and operates on the four-stroke principle. The engine 12 is comprised of a cylinder block 26 in which a pair of horizontally extending vertically, spaced cylinder bores 27 are formed. Pistons 28 are supported for reciprocation within the cylinder bores and are connected by means of piston pins 30 to one end of connecting rods 29. The other ends of the connecting rods are journaled on a crankshaft, indicated generally by the reference numeral 31. The crankshaft 31 is supported for rotation within a crank chamber 32 in a suitable manner between the cylinder block 26 and a crankcase 33 that is affixed to the cylinder block 26. The crankshaft 31 is drivingly coupled to the drive shaft 15 in a suitable manner.

A cylinder head, indicated generally by the reference numeral 34, is affixed to the cylinder block 26 with a cylinder head gasket 35 being interposed therebetween for providing a seal between the two surfaces. The cylinder head 34 is provided with a pair of recesses 36, each of which cooperates with the cylinder bore 27 and piston 28 to form the respective combustion chamber.

An intake valve 37 is supported in the cylinder head 34 for each combustion chamber 36 (FIG. 3). The intake valves 37 control the flow of fuel/air mixture from an induction system including a cylinder head intake passage and associated carburetor (not shown) which may be of any conventional construction. In a similar manner, an exhaust valve 38 is supported for reciprocation within the cylinder head 34 for each of the combustion chambers 36 and controls the flow of exhaust gases from the chambers 36 to the atmosphere through a suitable exhaust system (not shown).

The intake and exhaust valves 37 and 38 are operated in a manner to be described by means of a camshaft 39 that is supported for rotation within the cylinder head 34 by a means also to be described. The camshaft 39 is contained within a cam chamber 41 of the cylinder head 34 which is closed by a cam cover plate 42. The cover plate 42 is affixed to the cylinder head 34 in any suitable manner.

The upper end of the camshaft 39 is exposed and carries a driven pulley or sprocket 43. A toothed belt 44 transfers drive from a driving sprocket 45 fixed to the exposed upper end of the crankshaft 31 to the driven sprocket 43 and camshaft 39.

Intake rocker arms 46 are journaled on an intake rocker arm shaft 47 carried by the cylinder head 34 and engage the tips of the stems of the intake valves 37 for operating the intake valves upon rotation of the camshaft 39. The camshaft 39 has, for this purpose, intake lobes 48 that engage the rocker arms 46 for operating them. In a similar manner, exhaust rockers 49 are carried on an exhause rocker shaft 51 which is, in turn, carried by the cylinder head 34. The exhaust rockers 49 engage the tips of the stems of the exhaust valves 38 so as to operate them. The exhaust rockers 49 are operated by exhaust lobes 52 of the camshaft 39. The intake and exhaust rockers 46 and 49 each have bearing surfaces 53 that are engaged with the respective cam lobes 48 and 52.

The engine 12 is provided with a lubricating system including a lubricant pump, indicated generally by the reference numeral 54. The lubricant pump 54 includes a main housing 55 that is received within an opening formed in the lower face of the cylinder head 34. The housing 55 is formed with an internal bore which serves the function of journaling the lower end of the camshaft 39 relative to the cylinder head 34. A pumping element 56 is contained within a pumping cavity 57 of the housing 55 and is driven from the camshaft 39 by means of a short drive shaft 58.

An oil pan or sump 59 is affixed to the underside of a spacer plate 60 that supports the engine 12 and which connects the power head to the drive shaft housing 14. An oil delivery tube 61 depends into the sump 59 and communicates with an inlet passage 62 formed in the cylinder block and an inlet passage 63 formed in the pump housing 55 for delivering lubricant to the pumping chamber 57.

Pressurized lubricant is delivered through a first cylinder block and cylinder head delivery passageway 65 for lubricating a lower main bearing journal portion 66 of the crankshaft 31. A suitable seal 67 is carried by the crankcase 33 and cylinder block 26 for sealing this journaled area. In addition, the crankshaft 31 is formed with a cross-drilled passage 68 that communicates with the pressure conduit 65 and which terminates in the journal portion of one of the crankshaft throws for lubricating a connecting rod main bearing portion 69 and its attached bearing cap 71.

A pressure delivery passage 72 extends from the outlet side of the pump 54 through the cylinder head 34 and intersects another cross-drilled passageway 78 of the cylinder head 34 and cylinder block 26. The passageway 78 extends to an upper main bearing 79 of the crankshaft 31 for lubricating this bearing. A seal 81 is carried by the cylinder block 26 and crankcase 33 for sealing this bearing. A cross-drilled passageway 82 extends through the crankshaft main bearing portion 78 into its throw for journaling the upper connecting rod main bearing 69 and bearing cap 71.

The upper end of the camshaft 39 is formed with a bearing portion 83 that is journaled in a bore 84 of the cylinder head 34. The upper passageway 78 terminates at this bearing surface for lubricating the camshaft bearing surface 83. A seal 85 is provided in the cylinder head 34 adjacent the outer side of the bearing surface 83.

With conventional prior art lubricating systems, lobe surfaces 86 of the intake cams 48 and lobe surfaces 87 of the exhaust cams 52 and the corresponding engaging surfaces 53 of the rocker arms 46 and 51 are lubricated in a pressure manner. With such an arrangement, however, lubricant does not reach these surfaces until a period of time after the engine has been running. Hence, during start up and initial running, these surfaces could be subject to wear due to lack of adequate lubrication. This problem is particularly acute when the engine is disposed with the axis of the camshaft 39 extending in a vertical direction, as is common practice with an outboard motor, as has been noted.

In accordance with this invention, an arrangement is provided whereby lubricant is always delivered to the surfaces 86 and 87, even when the engine is not running. For this purpose, the cylinder head 34 is provided with individual recesses adjacent the cam cavity 41 in which bodies of porous material 88, such as sponge rubber or the like, are pressed. The sponge rubber or porous material bodies 88 are disposed so that they will be constantly in engagement with the cam surfaces 86 and 87 and also so that they are disposed immediately beneath the camshaft bearing 83. Hence, lubricant will be delivered ownwardly from the bearing 83 onto the porous bodies 88 so that they will be saturated with oil. Thus, even when the engine is not running, the porous bodies 88 will be saturated with oil. Upon cranking for starting, therefore, the surfaces 86 and 87 and the rocker arm surfaces 53 will all receive lubricant immediately and regardless of whether or not pressurized oil is delivered. Hence, wear is substantially reduced.

A drain passage 89 is formed in the cylinder head lower surface 34 in communication with the lower portion of the cam cavity 41. The drain passage 89 mates with a corresponding drain area 91 formed in the lower face of the cylinder block 26 and is aligned with an oil return opening 92 in the spacer plate 60 that is disposed immediately above the oil reservoir 59 so that oil can be returned to this reservoir when it has circulated through the camshaft arrangement. In a similar manner, a drain opening 93 is formed in the lower face of the crankcase chamber 32 so as to permit oil from the crankcase to drain back into the reservoir 59.

FIG. 4 shows a slightly different embodiment of the invention. The embodiment of FIG. 4 employs a slightly different arrangement for mounting the porous sponge rubber members from the embodiment of FIGS. 1 through 3 and, for that reason, only this portion of the construction has been illustrated. The cylinder head 34 is provided with a ledge 101 on which a plurality of carrier elements 102 are secured by machine screws 103. The carrier elements 102 each have recesses that carry a porous sponge rubber bodies 104 that will contact the cam surfaces 86 and 87 in the same manner as the embodiment of FIGS. 1 through 3. In addition, the porous members 104 are disposed so that they will be positioned beneath the camshaft bearing 83 and will receive lubricant from it.

FIG. 5 shows a further modified embodiment of the invention. In the previously described embodiments, the sponge rubber bodies 88 and 104 were all held in a fixed position. This is acceptable since they can deflect to follow the cam lobe surfaces 86 and 87. However, in this embodiment, a leaf spring 121 is affixed to the cylinder head 34 by means of a machine screw 122. Each leaf spring carries a foam pad 123 formed from rubber or some other suitable porous material which engages the cam lobes 86 and 87. As the camshaft 39 rotates, the leaf spring 121 will deflect as shown in the solid line of this figure so that the foam member 123 will follow its profile and insure adequate lubrication.

It should be readily apparent from the foregoing description that a number of embodiments of the invention have been illustrated and described, each of which insures good lubrication for the camshaft surfaces immediately upon starting and even during cranking of the engine without dependence on its pressure lubrication system.

Although a number of embodiments have been illustrated and described, various other changes and modifications may be made without departing from the spirit and scope of the invention, as defined by the appended claims.

I claim:

1. In a lubricating system for an internal combustion engine including a camshaft journaled by said engine, a lubricating system for said engine including a lubricant pump for delivering lubricant under pressure to at least some components of said engine, the improvement comprising porous means adapted to engage a surface of said camshaft to be lubricated and means for delivering lubricant from said lubricant pump to said porous means.

2. In a lubricating system as set forth in claim 1 wherein the porous means engages the lobes of the camshaft.

3. In a lubricating system as set forth in claim 2 wherein the camshaft is journaled in the cylinder head of the engine and the porous means are carried by the cylinder head.

4. In a lubricating system as set forth in claim 3 wherein the porous means are carried by separate members affixed to the cylinder head.

5. In a lubricating system as set forth in claim 4 wherein the separate members are resilient for permitting the porous means to follow the profiles of the cam.

6. In a lubricating system as set forth in claim 1 wherein the porous means are disposed immediately beneath a pressure lubricated bearing of the camshaft and lubricant flows by gravity from the bearing to the porous means thereby constituting the means for delivering lubricant to the porous means.

7. In a lubricating system as set forth in claim 1 wherein the camshaft is disposed with its axis of rotation extending in a vertical direction.

8. In a lubricating system as set forth in claim 7 wherein the porous means engages the lobes of the camshaft.

9. In a lubricating system as set forth in claim 8 wherein the camshaft is journaled in the cylinder head of the engine and the porous means are carried by the cylinder head.

10. In a lubricating system as set forth in claim 9 wherein the porous means are carried by separate members affixed to the cylinder head.

11. In a lubricating system as set forth in claim 10 wherein the separate members are resilient for permitting the porous means to follow the profiles of the cam.

12. In a lubricating system as set forth in claim 7 wherein the porous means are disposed immediately beneath a pressure lubricated bearing of the camshaft and lubricant flows by gravity from the bearing to the porous means thereby constituting the means for delivering lubricant to the porous means.

13. In a lubricating system as set forth in claim 7 wherein the engine comprises the engine of an outboard motor having a drive shaft housing and a lower unit containing a propeller driven by the engine, the engine being supported with its output shaft rotating about a vertically extending axis.

14. In a lubricating system as set forth in claim 13 wherein the porous means engages the lobes of the camshaft.

15. In a lubricating system as set forth in claim 14 wherein the camshaft is journaled in the cylinder head of the engine and the porous means are carried by the cylinder head.

16. In a lubricating system as set forth in claim 15 wherein the porous means are carried by separate members affixed to the cylinder head.

17. In a lubricating system as set forth in claim 16 wherein the separate members are resilient for permitting the porous means to follow the profiles of the cam.

18. In a lubricating system as set forth in claim 13 wherein the porous means are disposed immediately beneath a pressure lubricated bearing of the camshaft and lubricant flows by gravity from the bearing to the porous means thereby constituting the means for delivering lubricant to the porous means.

* * * * *